US005976027A

United States Patent [19]

Kachmar

[11] Patent Number: 5,976,027

[45] Date of Patent: Nov. 2, 1999

[54] GOLF SWING STANCE STABILIZER

[76] Inventor: John Kachmar, c/o Paul D. Gornall, 960-355 Burrard St., Vancouver, B.C., Canada, v6C 2G8

[21] Appl. No.: 09/192,689

[22] Filed: Nov. 16, 1998

[51] Int. Cl.[6] ..... A63B 69/36

[52] U.S. Cl. ..... 473/273

[58] Field of Search ..... 473/218, 272, 473/273

[56] References Cited

U.S. PATENT DOCUMENTS

| | | | |
|---|---|---|---|
| 3,658,344 | 4/1972 | Kimble | 473/273 |
| 3,955,821 | 5/1976 | Spedding | 473/272 X |
| 4,023,810 | 5/1977 | Lorang | 473/218 |
| 4,657,258 | 4/1987 | Melov et al. | 473/272 |

*Primary Examiner*—George J. Marlo

[57] ABSTRACT

This invention relates to golf training devices, and in particular discloses a device for stabilizing a golfer's feet and stance while he practices his swing. In a preferred embodiment, the device comprises a substantially flat mat in which a left foot gripping element and a right foot gripping element are each slidably engaged. The gripping element have a front tongue and a rear tongue respectively engaged with a front groove in a raised front border and with a corresponding rear groove in a raised rear border of the flat mat. The gripping element can thus secure a golfer's feet parallel to each other in a given stance while the golfer practices a golf swing. The gripping element can be slid nearer or farther away from each other and locked in the selected position to provide a variety of widths of stance. The device is thus useful as a training device in order to prevent the golfer from getting his feet in the wrong orientation to each other during the course of his swing. The device also enables the beginning golfer to start practicing his swing with his feet parallel but close together, and gradually work his way up to a wider stance.

10 Claims, 3 Drawing Sheets

GOLF SWING STANCE STABILIZER

FIELD OF THE INVENTION

This invention relates to golf training devices, and in particular discloses a device for stabilizing a golfer's feet and stance while he practices his swing.

DESCRIPTION OF THE PRIOR TECHNOLOGY

There exist prior devices that consist of lines and markings on a mat to assist a golfer in placing his feet parallel to each other and perpendicular to the intended path of a golf ball. Some such devices also have markings to assist in foot placement for achieving a fade or hook shot.

None of the prior technology discloses the arrangement of features that comprise this invention.

SUMMARY OF THE PRESENT INVENTION

In a preferred embodiment, the device comprises a substantially flat mat in which a left foot gripping means and a right foot gripping means are slidably engaged by a tongue and groove within the flat mat, for securing a golfer's feet parallel to each other in a given stance while the golfer practices a golf swing. The gripping means can be slid nearer or farther away from each other and locked in the selected position to provide a variety of widths of stance. The device is thus useful as a training device in order to prevent the golfer from getting his feet in the wrong orientation to each other during the course of his swing. The device also enables the beginning golfer to start practicing his swing with his feet parallel but close together, and gradually work his way up to a wider stance.

The basic purpose of the invention is to provide a means of stabilizing the golfer's feet and legs while he is in the process of swinging the golf club. To that end, the invention provides left foot gripping means and right foot gripping means each comprising:

a) a substantially flat plate;

b) a curved raised heel wail against which the golfer can place a back heel portion of a shoe worn by the golfer;

c) a back strap for wrapping around a front portion of an ankle of the golfer to secure the shoe worn by the golfer against the curved raised heel wall;

d) a front strap for wrapping around a front portion of a foot of the golfer to secure the shoe worn by the golfer against a front top portion of the substantially flat plate;

A preferred arrangement for the straps is to have each of the front strap and the back strap comprising adjustable complementary mechanically adhesive strips sewn around bars mounted on the substantially flat plate in order to secure rapidly a variety of sizes of golfer's shoe.

Another purpose of the invention is to provide a means of allowing the golfer to advance his practicing of his swing from a narrow stance to a wide stance. One of the most common errors of a beginning golfer is twisting his feet on the ground during the course of his swinging of a golf club. It is usually easier for a golfer to maintain throughout his swing the correct parallel orientation of his feet when they are close together. After the golfer has mastered this continuing orientation in a narrow stance with the aid the foot gripping means of the device of this invention, he can readily progress to practicing his swing while keeping his feet parallel while in a wider stance. The wider stance is eventually desirable to provide a solid framework from which to swing the club and connect with great power to the ball.

To this end, the invention provides golfer stance width position indicators mark in at least five equally spaced positions. The positions correspond to a stance range from a beginning golfer's narrow stance placing the left foot gripping means and right foot gripping means adjacent to each other to a practiced golfer's open stance with the left foot gripping means and the right foot gripping means at least ten inches apart.

When the golfer's feet and secure, his legs will naturally tend also to remain in the correct position. The golfer's swing will therefore depend, more correctly, on the swing of the arms and the rotation of the golfer's shoulders. Practice with the device of this invention will assist the golfer in learning the correct position of his body, and in maintaining balance in this position, throughout his golf swing.

DETAILED DESCRIPTION

Figure 1:
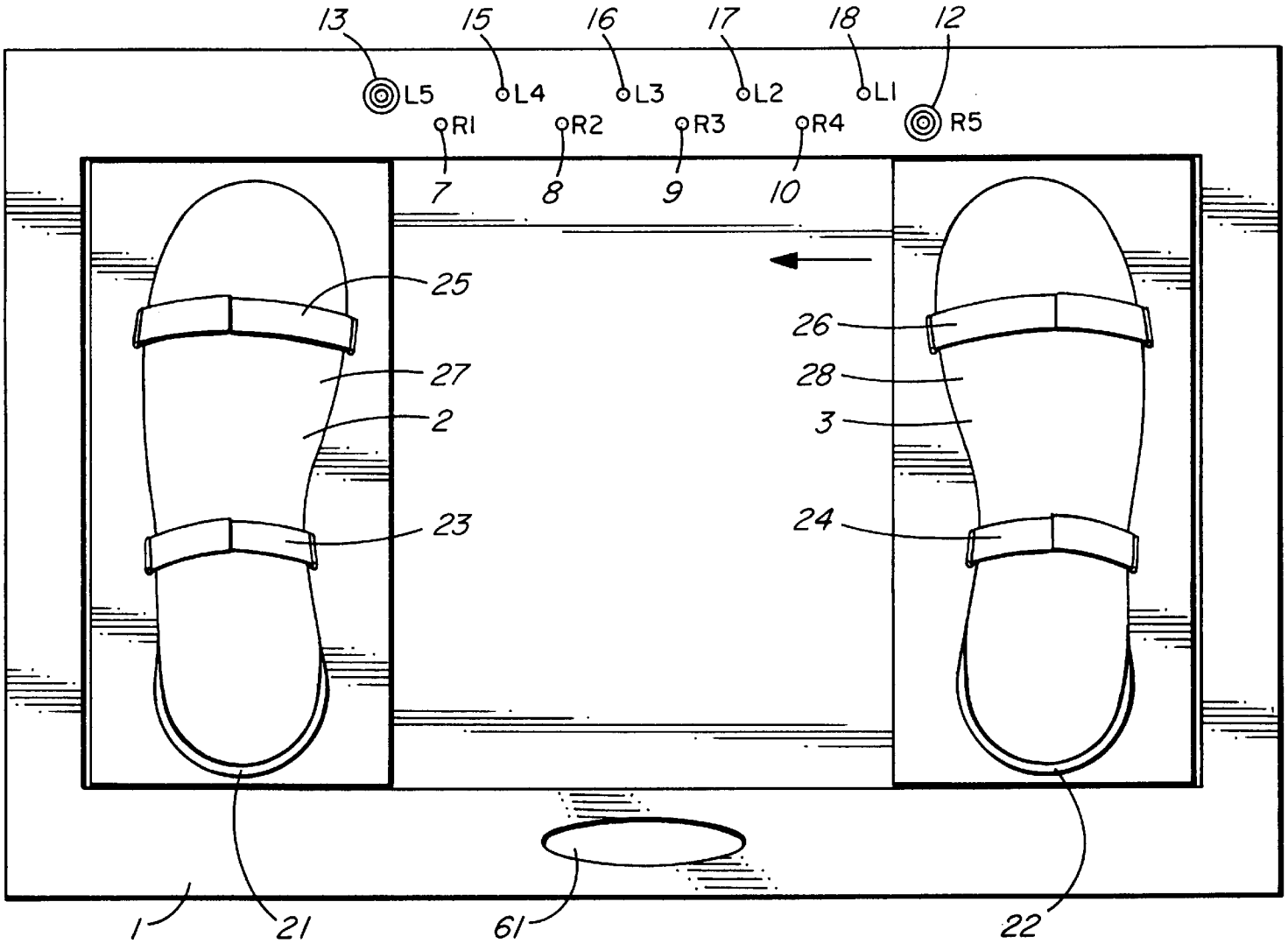
FIG. 1 is a top view showing a preferred embodiment of this device.
Figure 4:
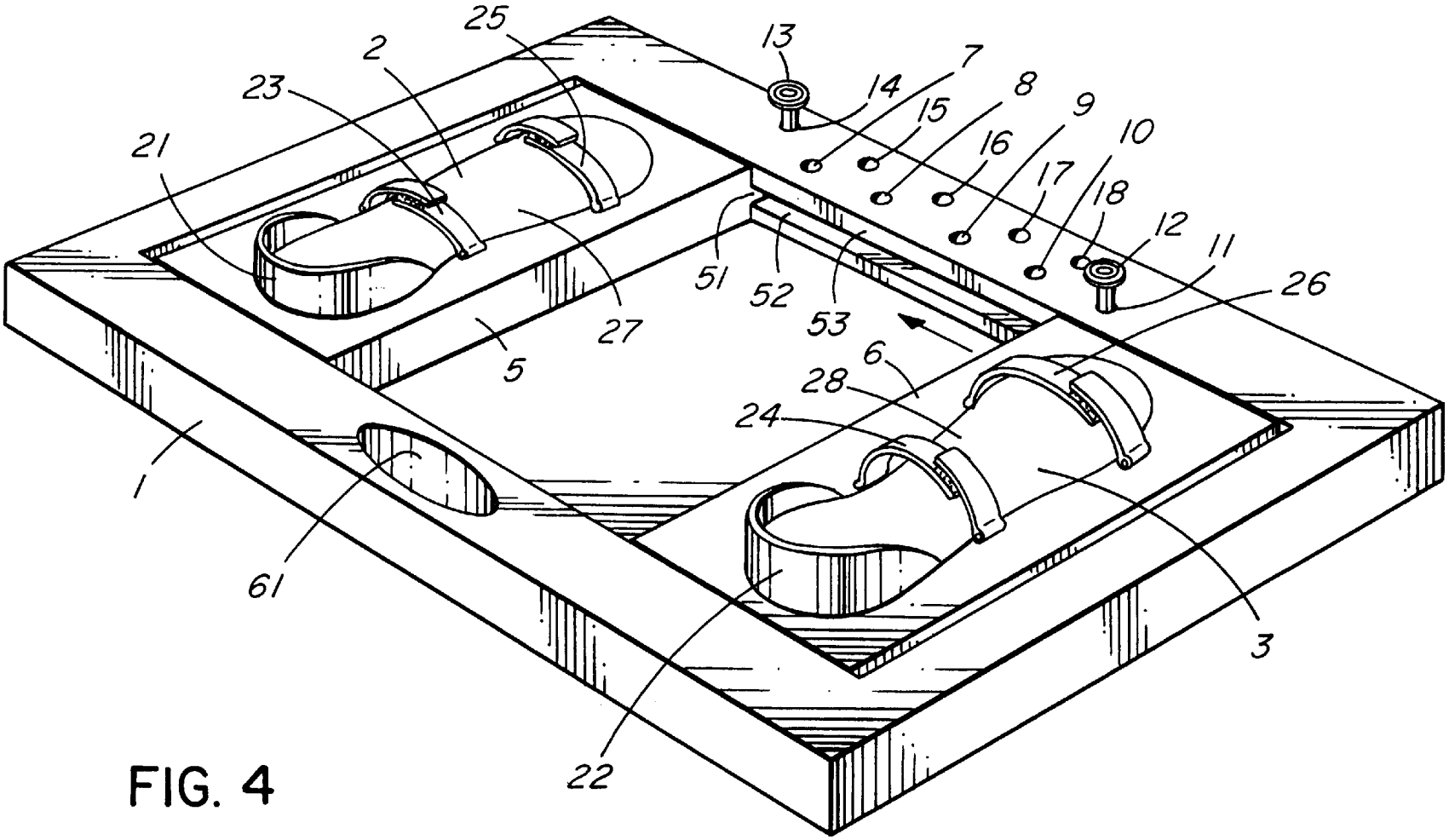
FIG. 4 is a perspective view of the device.

Referring to FIGS. 1 and 4, the device comprises a substantially flat mat 1, left foot gripping means 2 and right foot gripping means 3, slidably engaged within the flat mat. Pin 12 can be placed through one of the holes 7, 8, 9, 10, or 11 to lock the left plate 5 in position in the flat mat and pin 13 can be placed through one of the holes 14, 15, 16, 17, or 18 to lock the right plate 6 in position in the flat mat 1. The holes can be aligned with holes in the plates 5 and 6 respectively and the pin can be inserted to protrude through the plates 5 and 6 in order to lock each plate and slidably engaged gripping means at a selected position within the substantially flat mat. The holes for the pins on the flat mat correspond to a variety of golfer stance width position indicators at which each slidably engaged gripping means can be secured. By this means, a golfer can select from a range of narrow to wide foot stance positions in which to secure his feet while he practices his golf swing. The right foot gripping means can be secured in any position from R5 to R1 by sliding it in the direction of the arrow. It is secured in position R5 by means of pin 12 in the R5 hole. The left foot gripping means can likewise be secured in any of the five positions marked as L5 through L1. The left foot gripping means 2 comprises a curved raised heel wall 21 against which the golfer can place a back heel portion of his left shoe. Likewise, the right foot gripping means 3 has a curved raised heel wall 22 against which the golfer can place a back heel portion of his other shoe. A left back strap 23 and a right back strap 24 are used for wrapping around a front portion of each ankle of the golfer to secure his shoes and feet against the respective curved raised heel walls 21 and 22. A left front strap 25 and a right front strap 26 for wrapping around a front portion of the respective feet of the golfer are used to secure the shoe worn by the golfer against a front top portion of the substantially flat plates 5 and 6. The top surface of the flat plates 5 and 6 is made of a non-slip material such as treaded rubber. To accommodate gripping means for a typical range of foot widths, each of the flat plates 5 and 6 should be at least six inches wide. A left foot gripping base 27 and a right foot gripping base 28 are screwed or otherwise affixed to the respective plates 5 and 6. The back straps 23 and 24 and the front straps 25 and 26 are adjustable in order to secure a variety of sizes of golfer's feet and shoes. A preferred strapping material is complementary mechanically adhesive strips which can be sewn around bars mounted on the gripping bases 27 and 28 or directly to the flat plates 5 and 6. If the plates 5 and 6 are approximately 6 inches wide each, then the overall width of the device should be approximately 24 inches in order to allow a distance of ten inches between the plates 5 and 6 when the widest open stance is selected. The length of each plate should be at least 15 inches in order to accommodate a variety of typical shoe sizes.

A golfing tee can be used in place of pin 12 to secure the gripping means in the desired position. A handle aperture 61 in a lower portion of the flat mat 1 enables the user to easily hold the device for carrying the desired golf practice location.

Figure 2:
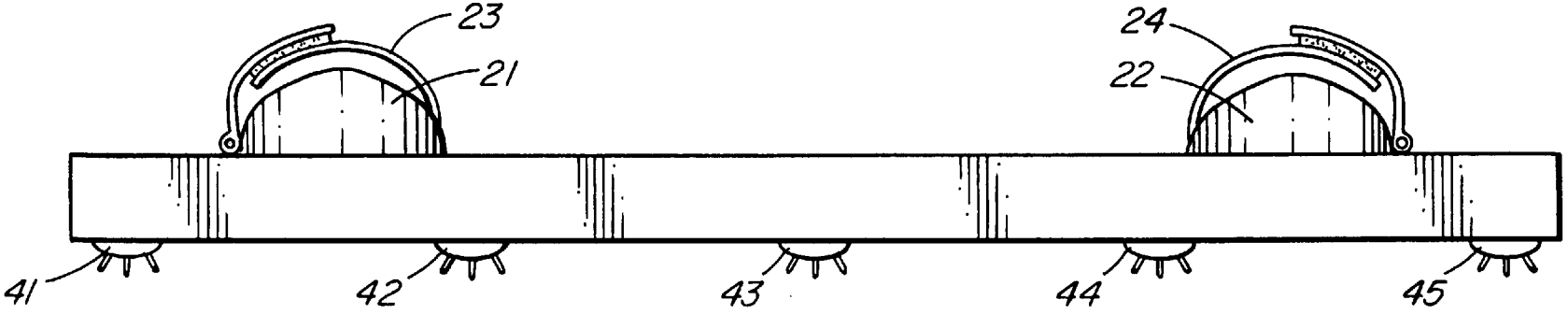
FIG. 2 is an end view of the device.
Figure 3:
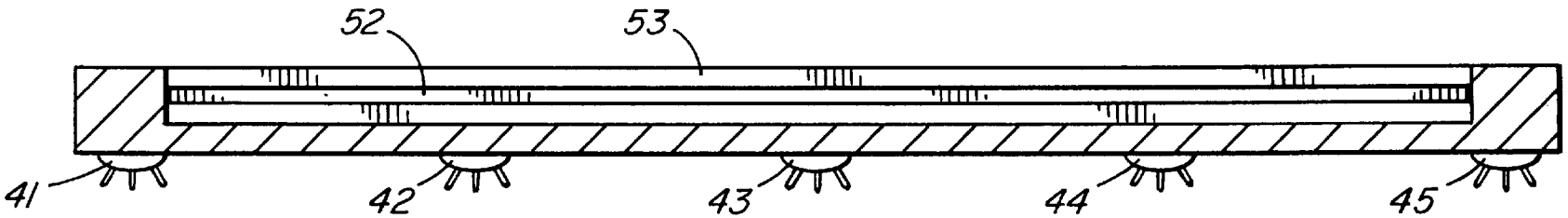
FIG. 3 is a cross-sectional end view of the device.

Referring to FIGS. 2 and 3, the substantially flat mat 1 has affixed to its lower surface a plurality of golf shoe spikes 41, 42, 43, 44, and 45 by which the mat 1 can grip a section of turf. In FIG. 2 the left back strap 23 and the right back strap 24 are used for wrapping around a front portion of each ankle of the golfer to secure his shoes and feet against the respective curved raised heel walls 21 and 22.

Referring to FIGS. 3 and 4, the left and right foot gripping means are each slidably engaged in the device by means of a tongue on each end of a respective plate fitting into a complementary groove in each raised end portion of the flat mat. The tongue 51 on the left plate 5 is shown, slidably engaged with the groove 52 at the far end raised portion 53 of the flat mat 1.

In a preferred embodiment, the golf stabilizer device of the present invention is made from plastic. A plastic molded flat mat with soft golf shoe spikes protruding from the bottom is used to hold by means of tongue and groove separate left and right foot gripping plates also made of plastic. Strap bases of non-slip plastic or rubber and mechanically adhesive straps sewn onto bars mounted on the strap bases complete each of the foot gripping means.

The device is designed for use on a flat surface and can be easily transported for use in different locations.

The within-described invention may be embodied in other specific forms and with additional options and accessories without departing from the spirit or essential characteristics thereof. The presently disclosed embodiment is therefore to be considered in all respects as illustrative and not restrictive, the scope of the invention being indicated by the appended claims rather than by the foregoing description, and all changes which come within the meaning and range of equivalence of the claims are therefore intended to be embraced therein.

I claim:

1. A device for stabilizing a golfer's stance having:

a) a substantially flat mat having a raised front border layer, a raised rear border layer, and raised left and right side border layers;

b) left foot gripping means and right foot gripping means, each of which is slidably engaged within the raised front border layer and within the raised rear border area of the flat mat, for securing a golfer's feet in a given position while the golfer practices a golf swing;

c) means for locking each slidably engaged gripping means at a selected position within the substantially flat mat; and d) a series of golfer stance width position indicators at which each slidably engaged gripping means can be locked;

whereby a golfer can select from a range of narrow to wide foot stance locked positions in which to secure his feet while he practices his golf swing.

2. The device of claim 1, in which the substantially flat mat has affixed to its lower surface a plurality of spikes by which the mat can grip a section of turf.

3. The device of claim 2, in which:

a) at least one of the left foot gripping means and right foot gripping means is slidably engaged in the substantially flat mat by means of a tongue formed along a front edge and a rear edge of at least one of the left foot gripping means and right foot gripping means and of a complementary groove formed in each of the raised front border layer and of the raised rear border layer of the substantially flat mat, b) the left foot and right foot gripping means each comprises:

i) a substantially flat plate, having a top surface of non-slip material;

ii) a curved raised heel wall against which the golfer can place a back heel portion of a shoe worn by the golfer;

iii) a back strap for wrapping around a front portion of an ankle of the golfer to secure the shoe worn by the golfer against the curved raised heel wall;

iv) a front strap for wrapping around a front portion of a foot of the golfer to secure the shoe worn by the golfer against a front top portion of the substantially flat plate;

c) the back strap and the front strap comprise adjustable complementary mechanically adhesive strips attached around bars mounted on the substantially flat plate in order to secure a variety of sizes of golfer's shoe;

d) the golfer stance width position indicators mark at least five equally spaced positions corresponding to a stance range from a beginning golfer's narrow stance placing the left foot gripping means and right foot gripping means adjacent to each other to a practiced golfer's open stance with the left foot gripping means and the right foot gripping means at least ten inches apart.

4. The device of claim 1, in which at least one of the left foot gripping means and right foot gripping means is slidably engaged in the substantially flat mat by means of a tongue formed along a front edge and a rear edge of at least one of the left foot gripping means and right foot gripping means and of a complementary groove formed in each of the raised front border layer and of the raised rear border layer of the substantially flat mat.

5. The device of claim 1, in which the left foot and right foot gripping means are each slidably engaged within the substantially flat mat.

6. The device of claim 5, in which the substantially flat plate of each of the left foot gripping means and right foot gripping is at least 6 inches wide.

7. The device of claim 5, in which the back strap and the front strap are adjustable in order to secure a variety of sizes of golfer's shoe.

8. The device of claim 1, in which the left foot and right foot gripping means each comprises:

a) a substantially flat plate, having a top surface of non-slip material;

b) a curved raised heel wall against which the golfer can place a back heel portion of a shoe worn by the golfer;

c) a back strap for wrapping around a front portion of an ankle of the golfer to secure the shoe worn by the golfer against the curved raised heel wall;

d) a front strap for wrapping around a front portion of a foot of the golfer to secure the shoe worn by the golfer against a front top portion of the substantially flat plate.

9. The device of claim 1, in which the back strap and the front strap comprise complementary mechanically adhesive strips affixed to bars mounted on the substantially flat plate.

10. The device of claim 1, in which the golfer stance width position indicators mark at least five equally spaced positions corresponding to a stance range from a beginning golfer's narrow stance placing the left foot gripping means and right foot gripping means adjacent to each other to a practiced golfer's open stance with the left foot gripping means and the right foot gripping means at least ten inches apart.

* * * * *